United States Patent [19]

Cale

[11] 4,016,691

[45] Apr. 12, 1977

[54] REVERSIBLE FOOT FOR RAILWAY HOPPER CAR INCLINED BRACES

[75] Inventor: Roland E. Cale, Cortland, Ohio

[73] Assignee: Schaefer Equipment Company, Warren, Ohio

[22] Filed: Apr. 23, 1975

[21] Appl. No.: 570,758

[52] U.S. Cl. ..... 52/298; 105/248; 105/406 R; 105/411; 248/188.91; 248/354 R

[51] Int. Cl.[2] ..... B61D 7/00; B61D 5/00; B61D 17/00; E02D 27/50;

[58] Field of Search ..... 52/146 298; 105/247, 105/248–253, 399, 406, 407, 411; 108/161; 248/351, 354 R, 357, 188.91; 297/449; 420/404, 409, 410

[56] References Cited

UNITED STATES PATENTS

| | | | |
|---|---|---|---|
| 1,630,001 | 5/1927 | Gardner | 105/411 X |
| 1,632,181 | 6/1927 | Gardner | 105/406 |
| 1,641,885 | 9/1927 | Gardner | 105/411 X |
| 1,710,501 | 4/1929 | Gardner | 105/411 |
| 1,732,438 | 10/1929 | Gardner | 105/411 |
| 1,834,264 | 12/1931 | Wine | 105/411 X |
| 1,859,261 | 5/1932 | Mussey, et al. | 105/411 X |
| 2,464,080 | 3/1949 | Hankins | 105/411 |

*Primary Examiner*—Robert J. Spar
*Assistant Examiner*—Howard Beltran
*Attorney, Agent, or Firm*—Brown, Murray, Flick & Peckham

[57] ABSTRACT

A reversible foot for the lower end of an inclined brace in a railway hopper car is a metal forging arched transversely to fit over a crossridge in the car, to which the foot is fastened. The foot is provided with a central vertical opening extending lengthwise of it for receiving the lower end of a brace inclined at a predetermined angle. The end wall of that opening that will be beside the upper inclined surface of the lower end of the brace is inclined substantially parallel to that surface, but the opposite end wall of the opening is inclined in the opposite direction at a different angle so that it will lie substantially parallel to the upper inclined surface of the lower end of a brace inclined at a different angle than the first-mentioned brace if the foot is reversed to receive such a brace. Whichever brace is used, its lower end is welded to the foot.

3 Claims, 5 Drawing Figures

REVERSIBLE FOOT FOR RAILWAY HOPPER CAR INCLINED BRACES

The bottoms of railway hopper cars are provided with areas inclined lengthwise of the cars in opposite directions, so that transversely extending ridges, called crossridges, are formed where the oppositely inclined areas join at the top. Some or all of the inclined areas are provided with doors that can be opened for emptying the contents of the cars by gravity. To brace the side walls of the cars, it is common practice to weld the upper ends of inclined braces to them and to weld the lower ends of the braces to feet made from metal forgings that are secured to the crossridges some distance inwardly from the side walls. Each of these feet has a central vertical opening in it for receiving the lower end of a brace, to which the foot is welded. Heretofore, the end walls of this opening have been inclined in the same direction and to the same extent as the brace. Thus, if a brace is inclined at an angle of 33°, for example, the end walls of the opening are inclined 33° so that they will be parallel to the brace surfaces beside them. This is satisfactory as long as all of the braces are supposed to be inclined at the same angle, but the car builder often finds that some braces are to be inclined at one angle, while other braces are to be inclined at a different angle. This means that the car builder must stock two different sets of feet for the braces so that the end walls of the openings in the feet will be inclined at the proper angles. Of course, it also means that the manufacturer of the feet must have two different sets of forging dies.

It is an object of this invention to provide a foot for connecting the lower end of an inclined brace to the crossridge in a railway hopper car, which will fit braces inclined at either of two different angles.

The preferred embodiment of the invention is illustrated in the accompanying drawings, in which FIG. 1 is a fragmentary cross section of a railway hopper car showing one of the inclined braces in place;

Figures 1, 2:
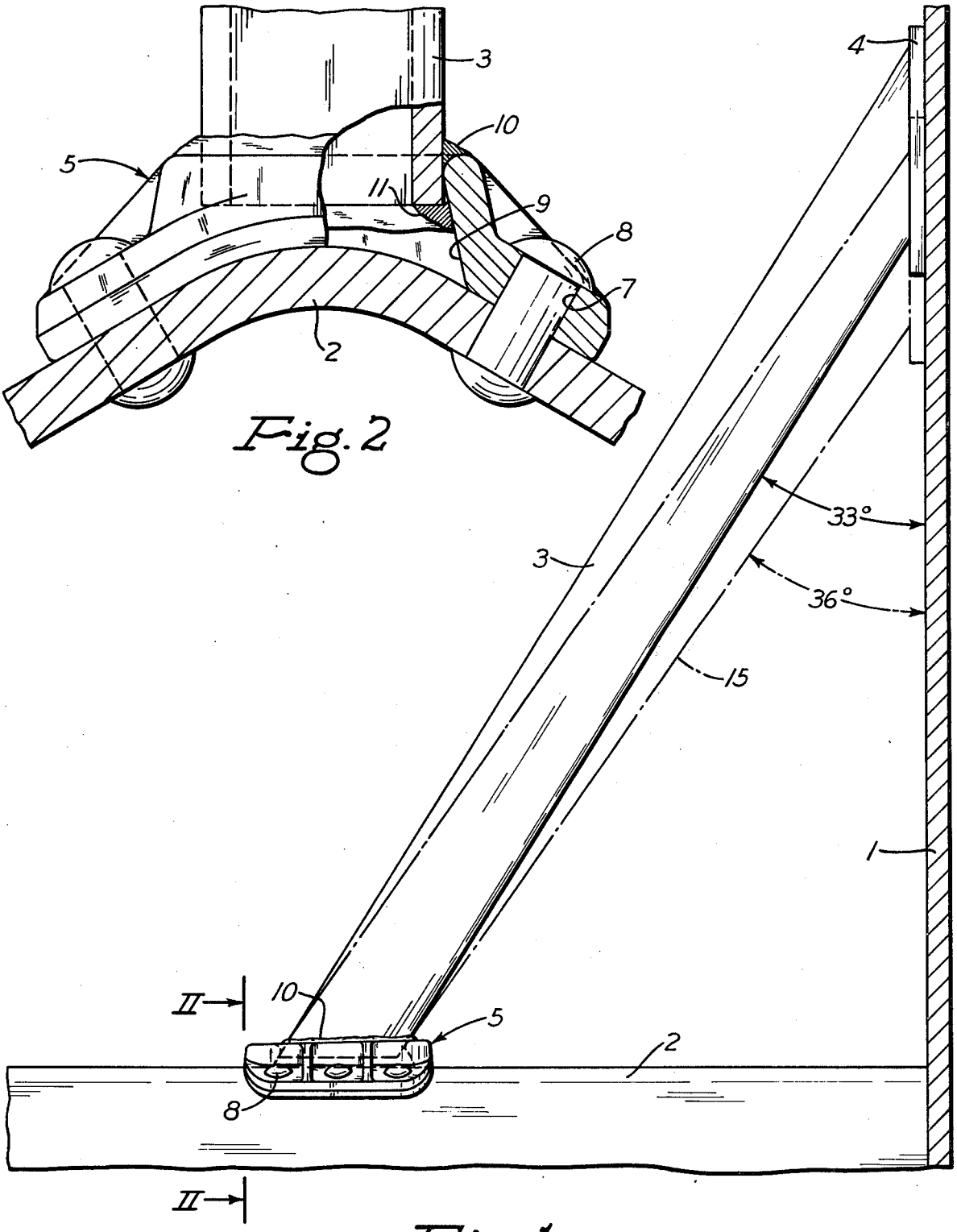
FIG. 2 is an enlarged fragmentary cross section of the crossridge showing the lower end of the brace and its foot, with parts broken away.
Figure 3:
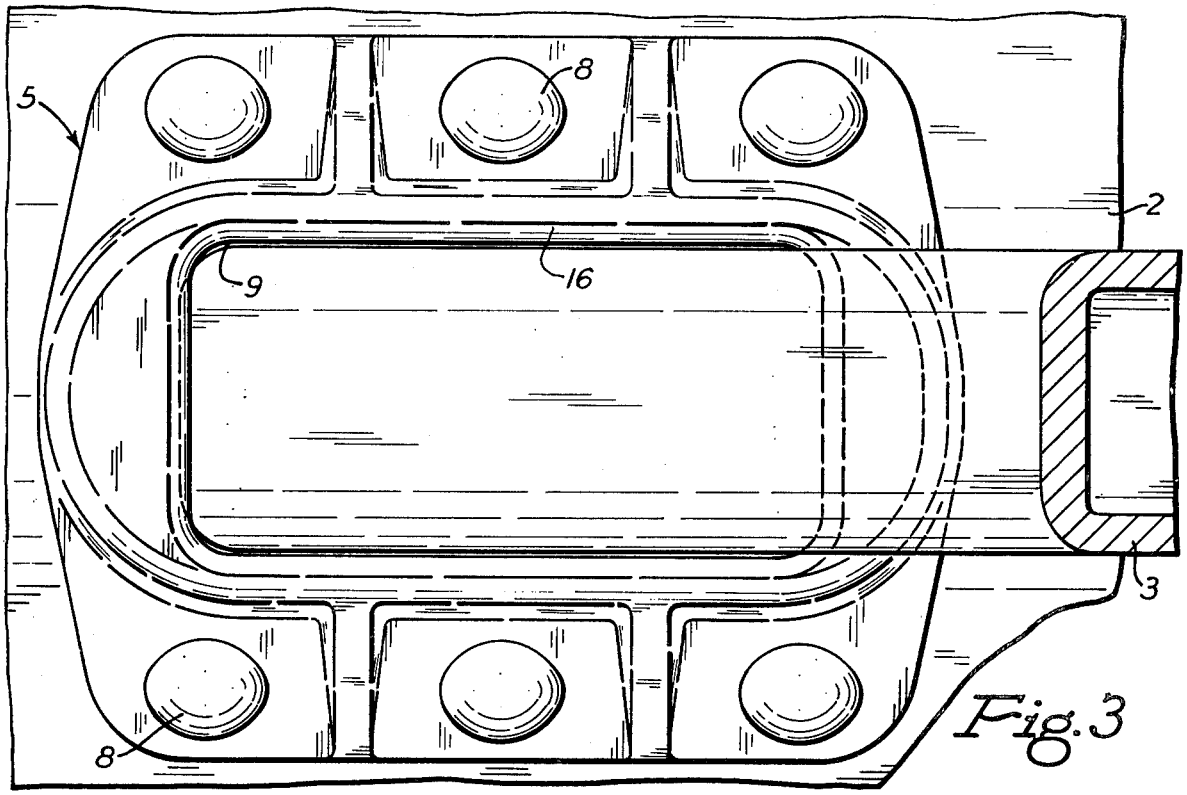
FIG. 3 is a plan view of the foot with the lower end of the brace fitting in it, but with the welds omitted for the sake of clearness.

Referring to FIG. 1 of the drawings, a railway hopper car has a vertical side wall 1 at one end of a crossridge 2 formed by inclined areas of the bottom of the car joined at their upper ends. Extending between the crossridge and a side wall of the car is an inclined brace 3, the upper end of which is secured to the wall in any suitable manner, such as by welding it to a plate 4 attached to the wall. The lower end of the brace is welded to a foot 5 that is welded or riveted to the crossridge in a location spaced inwardly from the side wall a distance dictated by the length and angle of the brace. The brace is rectangular in cross section.

Figure 4:
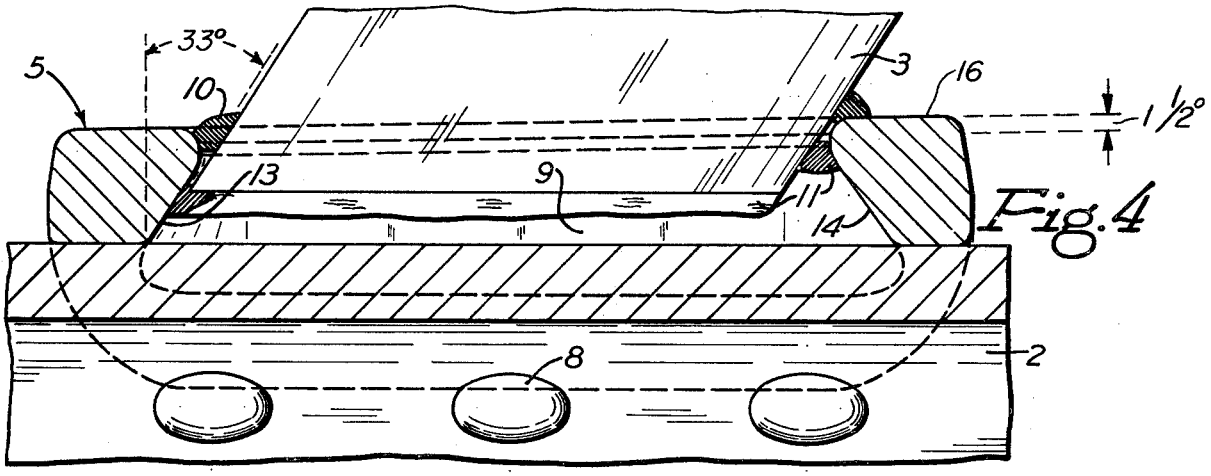
FIG. 4 is a fragmentary longitudinal section of the foot welded to the lower end of the brace.

The foot 5 is a metal forging that is arched transversely to fit the crossridge as shown in FIG. 2, with the opposite sides of the foot provided with openings 7 through which rivets 8 extend. The central portion of the foot is thicker than the rest of it and is provided with a central vertical opening 9 through it extending lengthwise of the crossridge and foot. The rectangular top of this opening is of such size that it will receive the lower end of the inclined brace with a small clearance around it. As shown in FIGS. 2 and 4, the brace is attached to the foot by welds 10 and 11 extending around the brace at the top of the opening and also around the lower end of the brace inside the opening. Of course, the brace and foot are welded together before being mounted in the hopper car.

As has been the practice heretofore, the end wall 13 of foot opening 9 behind the upper inclined surface of the lower end of the brace is inclined at the same angle as the brace so that it is parallel to that surface as shown in FIG. 4. It will be seen, however, that if a brace is used that is at a different inclination than the one shown, the inclined end wall 13 will no longer be parallel to the upper surface of the brace and the brace may not even fit in the opening if the latter is made as it has been heretofore. Accordingly, it is a feature of this invention that the foot is shaped in such a manner that by reversing it (turning it end for end) it will properly fit a brace inclined at a different predetermined angle.

Figure 5:
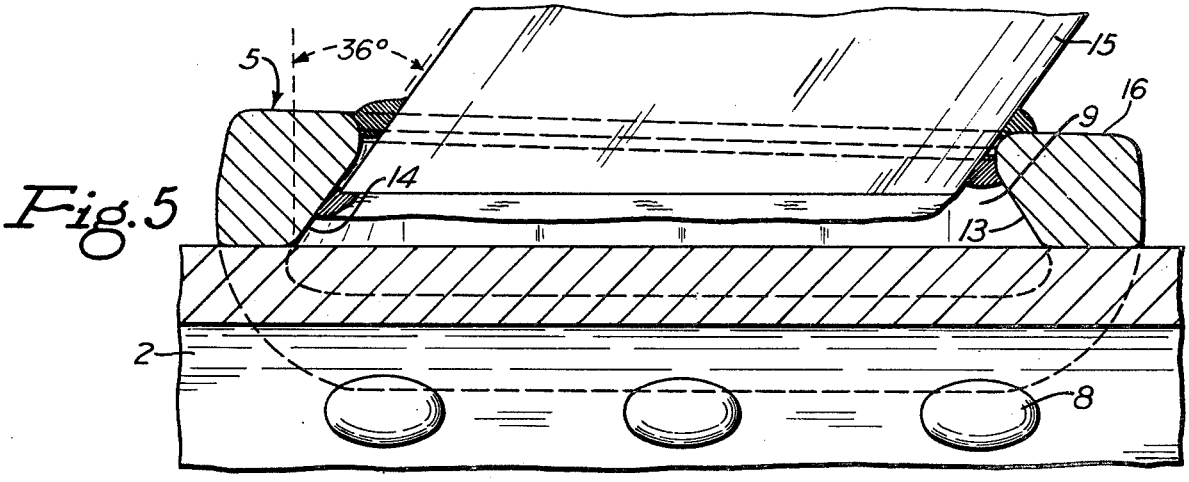
FIG. 5 is a view like FIG. 4, except that the foot has been reversed to receive the lower end of a brace inclined at a different angle than the one in the other figures.

In order to do this the end wall 14 of the foot opening opposite inclined end wall 13 is inclined in the opposite direction and at a different angle to match the angle of a brace 15 inclined less steeply than the brace shown in FIG. 1. Such a brace 15 is indicated in dotted lines in FIG. 1 and its lower end is shown in FIG. 5 inserted in the foot that has been reversed to receive it. It will be seen in FIG. 5 that the angle of end wall 14 overlying the upper surface of the inclined brace is parallel to it, the same as is the case in FIG. 4 where the foot is turned the other way and used with the other brace. Also, in both cases the clearance between the braces and the surrounding wall of the foot opening remains the same.

In practice, one brace may be inclined to the vertical at an angle between 30° and 35°, for example, while the other brace is inclined at a greater angle up to about 40°. Customary angles are 33° and 36°. In such cases, the left-hand end wall 13 of the foot opening 9 in FIG. 4 is inclined at a 33° angle to the vertical, while the opposite end wall 14 is inclined at an angle of 36° (FIG. 5) to the vertical. Such a foot can be used with braces inclined at either 33° or 36° and will fit both equally well, so the car builder needs to stock only one type of foot.

To facilitate making the dies for forging the foot, it is designed so that its top 16 slopes upwardly from the end that has the more steeply inclined end wall for opening 9 to the opposite end of the foot. The slope should be one-half the difference between the degrees of inclination of the end walls of the opening. In the specific example given, where those end walls are inclined at 33° and 36°, one-half of the difference is 1½°, which is the slope of the top of the foot lengthwise. Another advantage of this slope is that it results in the end of the foot at the upper end of the slope being thicker vertically than the other end to make up for the reduction in horizontal thickness due to the greater angle of end wall 14, whereby the two ends of the foot have approximately the same cross-sectional area.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A reversible foot for connecting to a railway hopper car crossridge the lower end of an inclined brace, said foot being a metal forging arched transversely to fit over a crossridge and having holes in its opposite sides for fasteners to hold it in place, the foot having a central vertical opening therein extending lengthwise of the foot for receiving the lower end of an inclined brace, said opening having spaced inclined end walls converging upwardly at two different predetermined angles for location beside the opposite inclined surfaces of the lower end of a brace in said opening inclined at one of said angles, with an end wall of said opening disposed substantially parallel to the upper inclined surface of the lower end of the brace, the inclination of the other of said end walls being such that if the shoe is turned end for end to receive a different brace inclined at the other of said predetermined angles said other end wall will lie substantially parallel to the upper inclined surface of the lower end of said different inclined brace, and the foot being adapted to be welded to the lower end of whichever inclined brace is disposed in said opening.

2. A foot according to claim 1, in which the vertical thickness of the foot at the end thereof that has the more steeply inclined of said upwardly converging end walls is less than the vertical thickness of the opposite end of the foot, and the foot has an upper surface surrounding said central opening that slopes downwardly from said thicker end of the foot to the other end of the foot

3. A foot according to claim 2, in which the angle that the slope of said upper surface makes with the horizontal is one-half the difference between the angles that said inclined end walls make with the vertical.

* * * * *